US005367707A

United States Patent [19]

Murai

[11] Patent Number: 5,367,707

[45] Date of Patent: Nov. 29, 1994

[54] BASEBALL GLOVE OR MITT

[75] Inventor: Hideaki Murai, Osaka, Japan

[73] Assignee: KSK Co., Ltd., Kagoshima, Japan

[21] Appl. No.: 153,912

[22] Filed: Nov. 17, 1993

[30] Foreign Application Priority Data

Jan. 26, 1993 [JP] Japan ..... 5-005761[U]

[51] Int. Cl.[5] ..... A41D 13/10

[52] U.S. Cl. ..... 2/19

[58] Field of Search ..... 2/19, 162, 160, 161.1

[56] References Cited

U.S. PATENT DOCUMENTS

| | | | |
|---|---|---|---|
| 2,113,934 | 4/1938 | Denkert | 2/19 |
| 3,300,787 | 1/1967 | Denkert | 2/19 |
| 3,576,036 | 4/1971 | Latina | 2/19 |
| 3,602,915 | 9/1971 | Collins | 2/19 |
| 4,527,287 | 7/1985 | Aoki | 2/19 |
| 4,651,345 | 3/1987 | Latina | 2/19 |
| 4,665,561 | 5/1987 | Aoki | 2/19 |
| 4,853,975 | 8/1989 | Clevenhagen | 2/19 |

*Primary Examiner*—Clifford D. Crowder
*Assistant Examiner*—Michael A. Neas
*Attorney, Agent, or Firm*—Armstrong, Westerman, Hattori, McLeland & Naughton

[57] ABSTRACT

A baseball catching tool having fixing device including a belt member for firmly gripping a hand inserted into the catching tool. The fixing device may include at least one pair of opposed belt members extended from the inner face of the catching tool to have their leading end portions threaded through a belt portion of the tool body to the surface of the tool body and fastened to each other. The belt members may have their roots bifurcated to position the thumb of the hand in the bifurcated roots of one of the belt members.

7 Claims, 12 Drawing Sheets

BASEBALL GLOVE OR MITT

BACKGROUND OF THE INVENTION

1. Field of the Invention

The present invention relates to a baseball catching tool such as a baseball glove, which can be used for baseballs while fixing the player's hand in position and freed from coming out even in case of a close play.

2. Description of the Related Art

In the ordinary baseball glove of the prior art, the player's hand is inserted into the glove to have its fingers positioned in the corresponding finger bags. Thus, the glove is worn for play such that the hand has its back and wrist held between the inner face and the belt portion of the glove.

In the existing baseball glove, however, the inserted hand may come out of position as the gloves moves during the play, to affect the play adversely. Especially in a rough play such as a close play, there arises a problem that the glove is pushed to come out of the hand.

SUMMARY OF THE INVENTION

It is, therefore, an object of the present invention to provide a baseball tool such as a baseball glove, which can fit a player's hand in it to offer free motions to the hand so that it can be prevented from being pushed to come out even in a close play.

In order to achieve the above-specified object, according to a first aspect of the present invention, there is provided a baseball catching tool comprising fixing means including a belt member for firmly gripping a hand inserted into the catching tool.

According to a second aspect of the present invention, the fixing means may include at least one pair of opposed belt members extended from the inner face of the catching tool to have their leading end portions threaded through a belt portion of the tool body to the surface of the tool body and fastened to each other.

According to a third aspect of the present invention, the belt members may have their roots bifurcated to position the thumb of the hand in the bifurcated roots of one of the belt members.

According to the baseball catching tool of the first aspect of the present invention, as described above, the hand can be inserted into the tool body and gripped firmly by wrapping the hand with the belt member of the fixing means.

In case the baseball catching tool according to the second aspect is used, the hand is inserted into the tool body, and the belt members are positioned at the two sides of the hand and fastened at their leading end portions. As a result, the inserted hand can be gripped sideways by the belt members and by the back of the belt portion and the surface of the lining of the tool body.

In case, moreover, the baseball catching tool according to the third aspect is used, the inserted hand can be completely prevented from moving out of position because the belt members are fastened with the thumb being positioned in the bifurcated roots of one of the belt members.

DESCRIPTION OF THE PREFERRED EMBODIMENTS

The present invention will be described in more detail in the following in connection with its embodiments with reference to the accompanying drawings.

Figure 1:
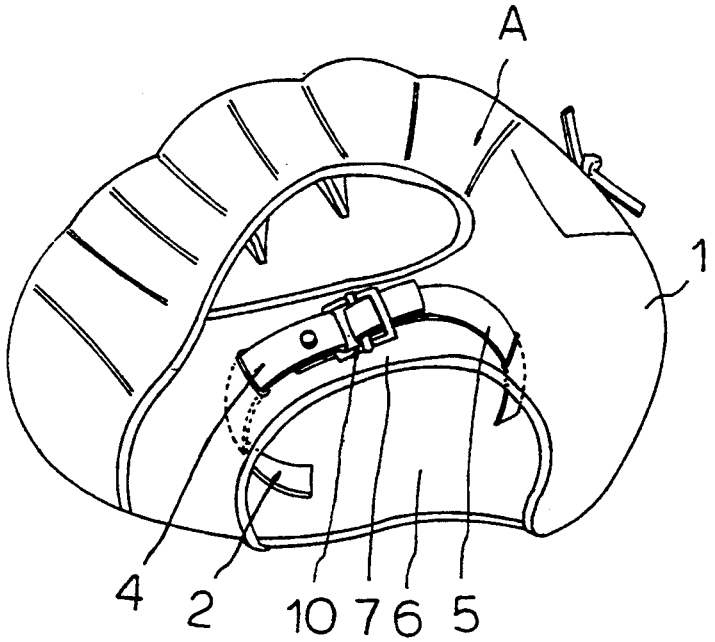
FIG. 1 is a perspective view showing a baseball glove according to a first embodiment.
Figure 2:
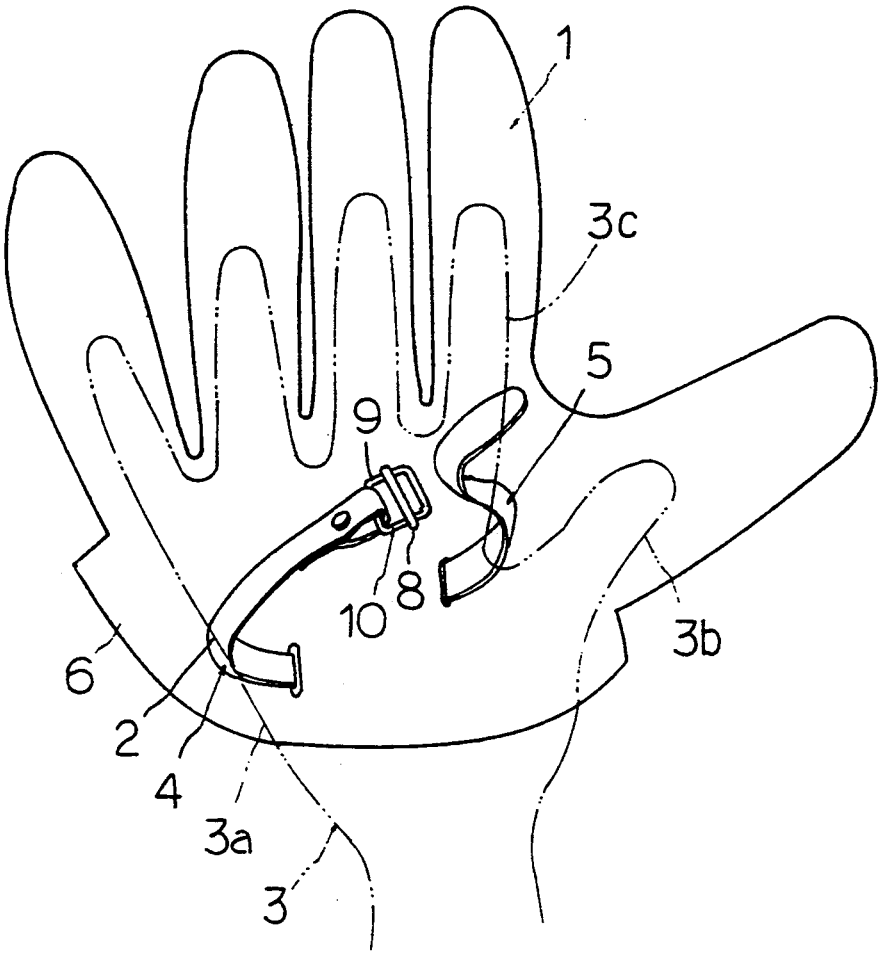
FIG. 2 is an explanatory perspective view showing a lining of the glove body equipped with fixing means of the first embodiment.

FIGS. 1 and 2 show a baseball glove A according to a first embodiment of the present invention. This baseball glove A has its body 1 equipped with fixing means 2 of the first embodiment.

The fixing means 2 of the first embodiment is constructed, as shown in FIGS. 1 and 2. Specifically, two belt members 4 and 5 are opposed at a spacing and so extended from the lining 6 of the glove body 1 as to grip the two sides of a hand 3 inserted. These belt members 4 and 5 have their leading end portions threaded through a belt portion 7 of the glove body 1, and a stopper 10 using a ring member 9 having a retainer 8 generally at its center is attached to the leading end portion of one belt member 4.

Especially, the fixing means 2 of the shown embodiment has its two belt members 4 and 5 extended, as shown in FIG. 2, from the lining 6 of the glove body 1 into a positional relation to grip the hand 3 at its side 3*a*, thumb 3*b* and forefinger 3*c*.

Next, the fixing means 2 according to a second embodiment will be described with reference to FIG. 3.

Figure 3:
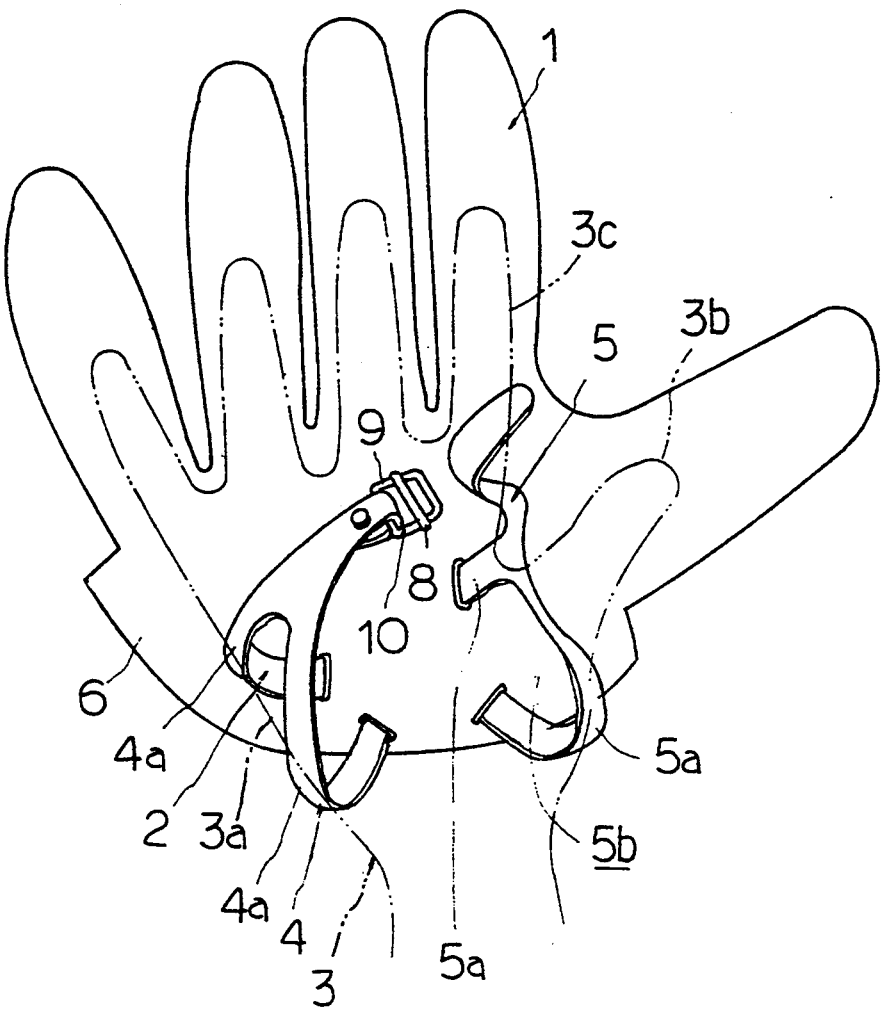
FIG. 3 is an explanatory perspective view showing a lining of the glove body equipped with fixing means of the second embodiment.

The fixing means 2 of the second embodiment is given, as shown in FIG. 3, a structure substantially identical to that of the fixing means 2 of the first embodiment. The belt members 4 and 5 have their respective roots 4*a* and 5*a* bifurcated to grip the hand 3 more firmly at its two sides. Especially, the other belt member 5 has its bifurcated roots 5*a* and 5*a* positioned such that their opening 5*b* can receive the thumb 3*b*. As a result, the glove worn by the hand can be completely prevented from moving out of position. Incidentally, the fixing means 2 described above according to the second embodiment is scheduled to be actually manufactured and sold.

The fixing means 2 according to a third embodiment will be described with reference to FIG. 4.

Figure 4:
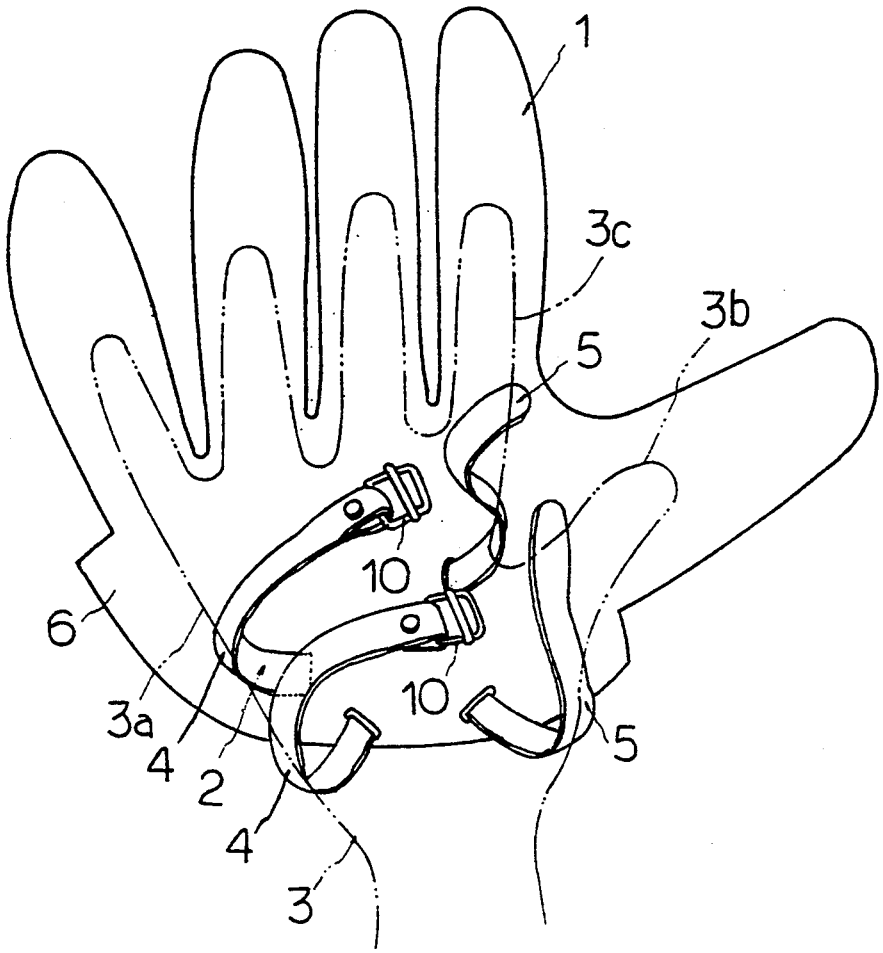
FIG. 4 is an explanatory perspective view showing a lining of the glove body equipped with fixing means of the third embodiment.

The fixing means 2 of the third embodiment is equipped with two pairs of belt members 4 and 5, which are exemplified in the fixing means 2 of the first embodiment, so that the thumb 3*b* may be positioned between the belt members 5 and 5, as shown in FIG. 4.

The fixing means 2 according to a fourth embodiment will be described with reference to FIG. 5.

Figure 5:
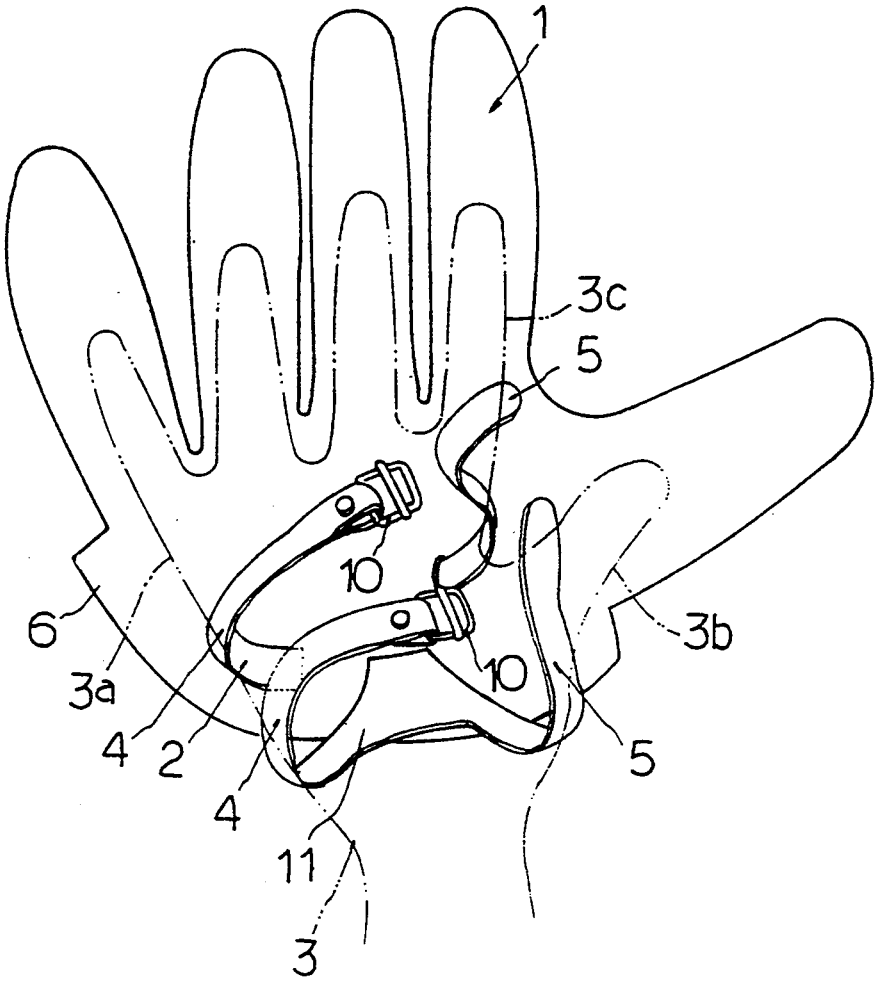
FIG. 5 is an explanatory perspective view showing a lining of the glove body equipped with fixing means of the fourth embodiment.

The fixing means 2 of this fourth embodiment is given, as shown in FIG. 5, a structure substantially identical to that of the foregoing fixing means 2 of the third embodiment. However, the belt member 4 and the belt member 5, as located at lower positions, have their roots connected to form a connector 11.

The fixing means 2 according to a fifth embodiment will be described with reference to FIG. 6.

Figure 6:
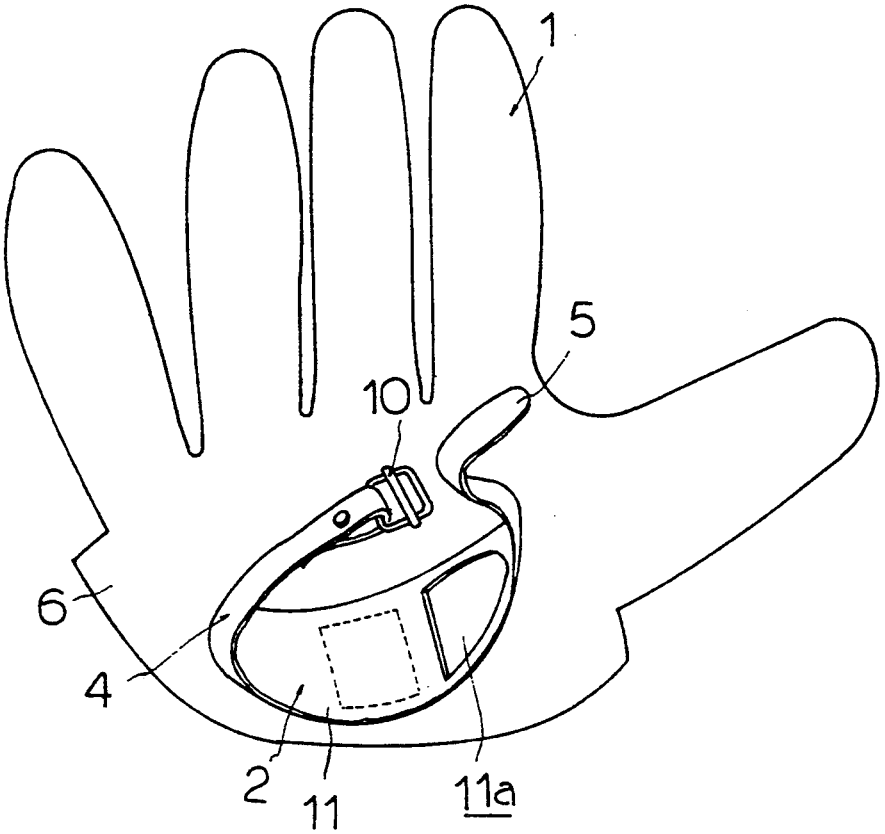
FIG. 6 is an explanatory perspective view showing a lining of the glove body equipped with fixing means of the fifth embodiment.

The fixing means 2 of this fifth embodiment is given, as shown in FIG. 6, a structure substantially identical to that of the foregoing fixing means 2 of the first embodiment. However, the belt member 4 and the belt member 5 have their roots connected to form a wide connector 11. These belt members 4 and 5 are made of an integrally shaped leather sheet, and the wide connector 11 is formed at the side of the belt member 5 with an insert hole 11*a* which is sized to receive the thumb. The connector 11 has its central portion stitched to the lining 6.

The fixing means 2 according to a sixth embodiment will be described with reference to FIG. 7.

Figure 7:
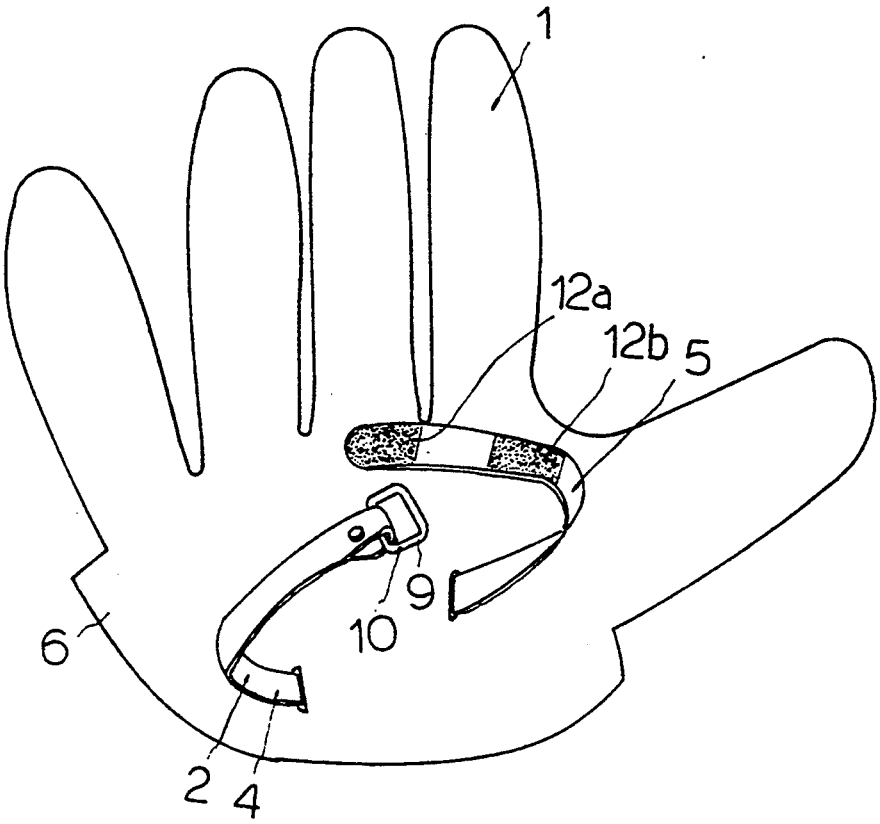
FIG. 7 is an explanatory perspective view showing a lining of the glove body equipped with fixing means of the sixth embodiment.

The fixing means 2 of this sixth embodiment is given, as shown in FIG. 7, a structure substantially identical to that of the foregoing fixing means 2 of the first embodiment. However, the stopper 10 is embodied such that one belt member 4 is equipped with the ring member 9 whereas the other belt member 5 is equipped with face fasteners 12*a* and 12*b* which are stitched at a spacing to the leading end portion of the belt member 5.

The fixing means 2 according to a seventh embodiment will be described with reference to FIG. 8.

Figure 8:
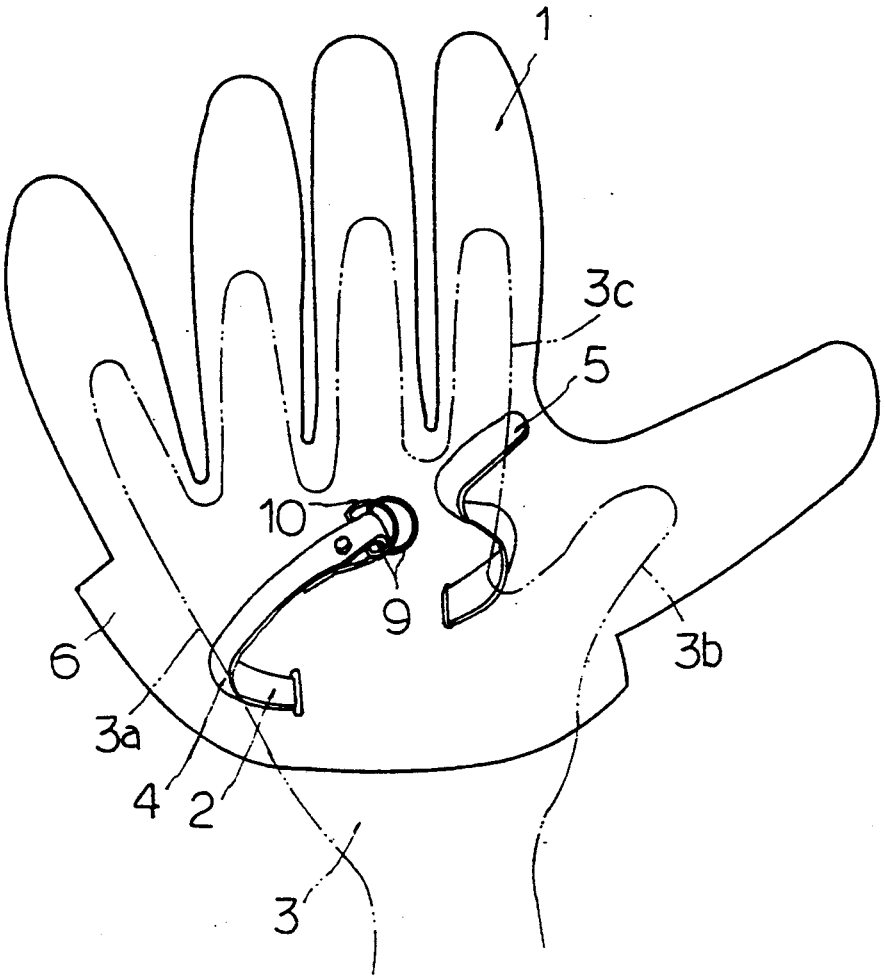
FIG. 8 is an explanatory perspective view showing a lining of the glove body equipped with fixing means of the seventh embodiment.

The fixing means 2 of this seventh embodiment is given, as shown in FIG. 8, a structure substantially identical to that of the foregoing fixing means 2 of the first embodiment. However, the stopper 10 is exemplified by another example. Specifically, the stopper 10 is embodied such that one belt member 4 is equipped at its leading end with two ring members 9, so that the stopper 10 can be actuated by having the leading end portion of the other belt member 5 entangled by the ring members 9 and 9. Thus, the stopper 10 may adopt any that include the remaining various known types of the prior art if the belt members 4 and 5 can have their leading end portions fastened to each other.

Incidentally, in all the foregoing fixing means 2 of the second to seventh embodiments, too, the stoppers 10 are fastened by threading the leading end portions of the belt members 4 and 5 through the belt portion 7 of the glove body 1 up to the surface of the glove 1, as in the fixing means 2 of the first embodiment shown in FIG. 1. Despite of this fact, however, the belt member 4 and 5 need not be positioned at the central portion of the belt portion 7 but may be offset to the righthand or lefthand end portion.

The baseball glove A of the second embodiment will be described in more detail with reference to FIG. 9.

Figure 9:
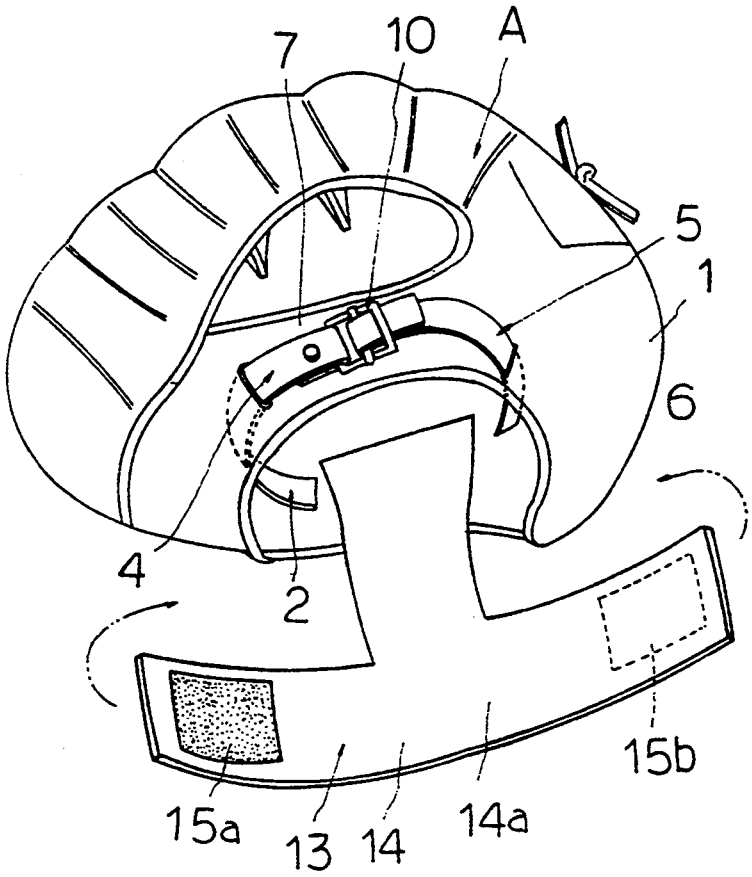
FIG. 9 is a perspective view showing a baseball glove according to a second embodiment.

The baseball glove A of the second embodiment is given, as shown in FIG. 9, a structure substantially identical to that of the baseball glove A of the first embodiment shown in FIG. 1, excepting that auxiliary fixing means 13 is provided in addition to the fixing means 2. Specifically, the auxiliary fixing means 13 is made of an auxiliary belt member 14 of a leather sheet generally having a shape of letter "T", which is extended from the surface of the lining 6 of the glove body 1. Face fasteners 15*a* and 15*b* are stitched to the two sides of a wrap portion 14*a*, at which the auxiliary belt member 14 is wrapped on the wrist of a player.

The baseball glove A of the third embodiment will be described in more detail with reference to FIGS. 10 and 11.

The baseball glove A of this third embodiment uses the fixing means 2 of an eighth embodiment. The fixing means 2 of this eighth embodiment is given a structure substantially identical to that of the fixing means 2 of the second embodiment of FIG. 3. As shown in FIG. 11, however, the leading end of the other belt member 5 is inserted into the ring member 9 used by the stopper 10 adopts a ring member 9 and is folded back. As shown in FIG. 10, moreover, the leading end of the other belt member 5 is threaded through the belt portion 7 of the glove body 1 up to the surface of the belt portion 7 until it is fastened by an auxiliary stopper 17 attached to a fastening belt 16. This auxiliary stopper 17 may also adopt various types, but the stopper 17, as shown in FIG. 10, adopts a ring member 19 having a retainer 18 generally at its center, as in the stopper 10 of FIG. 1.

Finally, the baseball glove A of the fourth embodiment will be described in more detail with reference to FIG. 12.

The baseball glove A of this fourth embodiment uses the fixing means 2 of a ninth embodiment. The fixing means 2 of this ninth embodiment is constructed, as shown in FIG. 12, such that the two belt members 4 and 5 are extended at a spacing from the surface of the lining 6 of the glove body 1, such that face fasteners 20*a* and 20*b* are stitched to the outer face of the leading end portion of the belt member 4 and the inner face of the leading end portion of the belt member 5, and such that outer face fasteners 21*a* and 21*b* are stitched to the inner face of the leading end portion of the belt portion 7 and the outer face of the end portion of the glove body 1, so that the face fasteners 20*a* and 20*b* and the face fasteners 21*a* and 21*b* may be removably fastened to each other.

Incidentally, in the embodiments thus far described, the present invention has been applied to the baseball glove A but can also be applied to baseball catching means such as first baseman's mitts or catcher's mitts.

Thus, according to the baseball glove A of the first embodiment of the present invention, the hand 3 is inserted into the glove body 1. As shown in FIG. 2, the belt member 4 of the fixing means 2 is positioned at the side 3*a* of the hand 3, and the belt member 5 is positioned between the thumb 3*b* and the forefinger 3*c*. Then, the belt member 5 is inserted into the ring member 9 of the stopper 10, as shown in FIG. 1, and is folded back and pulled while being retained by the retainer 8. As a result, the inserted hand 3 is gripped in position at its sides by the belt members 4 and 5 and by the back of the belt portion 7 and the surface of the lining 6 of the glove body 1.

In case the fixing means 2 of the second to seven embodiments are used, too, the hand 3 can be gripped in position in the glove body 1 by fastening the belt members 4 and 5 by the stopper 10. Especially in case the fixing means 2 of the second to fourth embodiments are used, the gripping effect can be enhanced because the hand 3 is gripped at the two portions by the belt members 4 and the belt members 5.

According to the baseball glove A of the second embodiment, moreover, the hand 3 is gripped in the glove body 1 by the fixing means, as shown in FIG. 9, like the baseball glove A of the first embodiment. After this, the wrist can be further gripped firmly by the wrap portion 14*a* of the auxiliary belt 14 member of the auxiliary fixing means 13.

Figure 10:
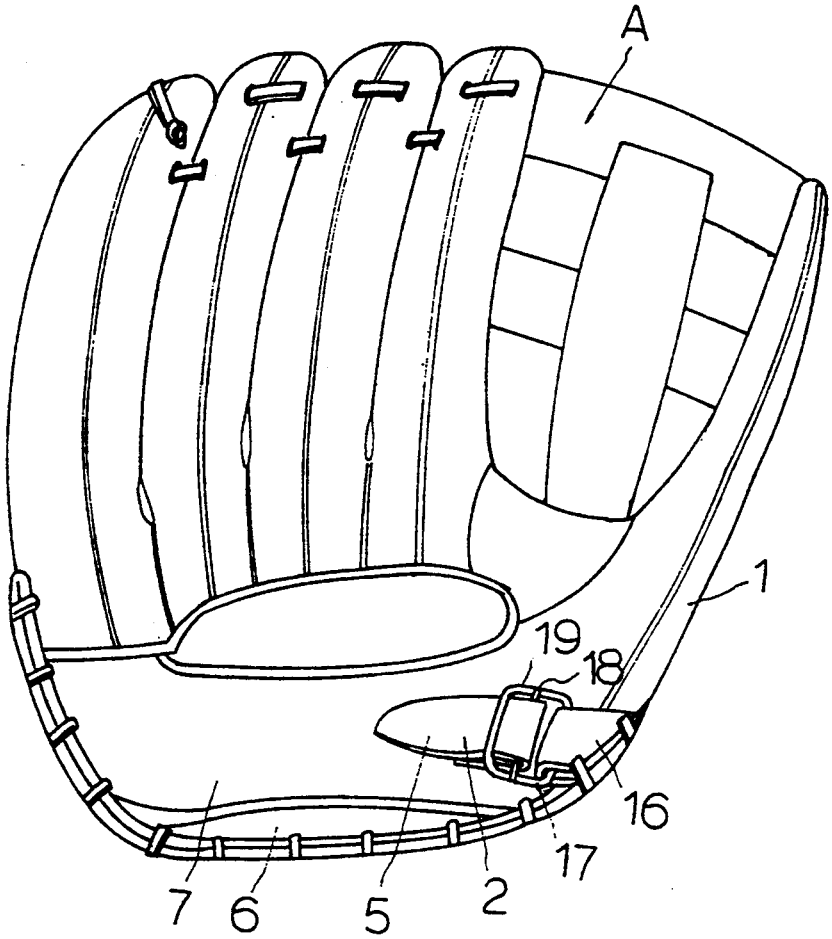
FIG. 10 is a perspective view showing a baseball glove according to a third embodiment.
Figure 11:
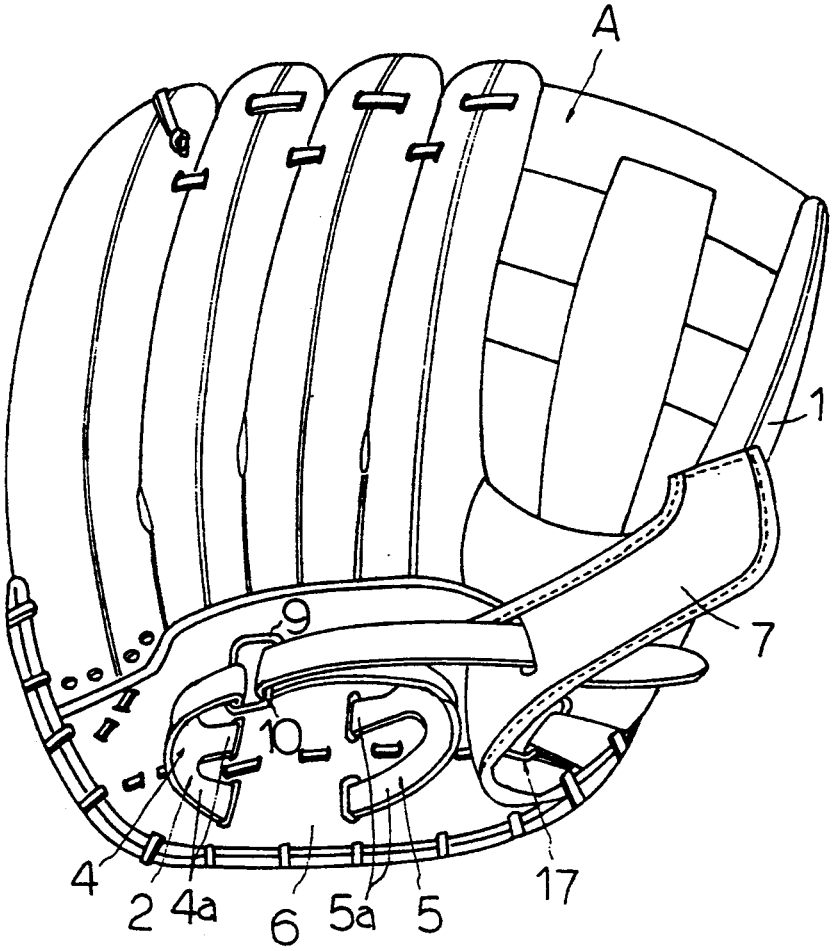
FIG. 11 is a perspective view showing a state in which the belt portion of the baseball glove of the third embodiment is opened.

According to the baseball glove A of the third embodiment, still moreover, the hand 3 is inserted into the glove body 1 in position between the belt member 4 and the belt member 5, as shown in FIGS. 10 and 11, and the leading end portion of the belt member 4 can be fastened by the auxiliary stopper 17.

Figure 12:
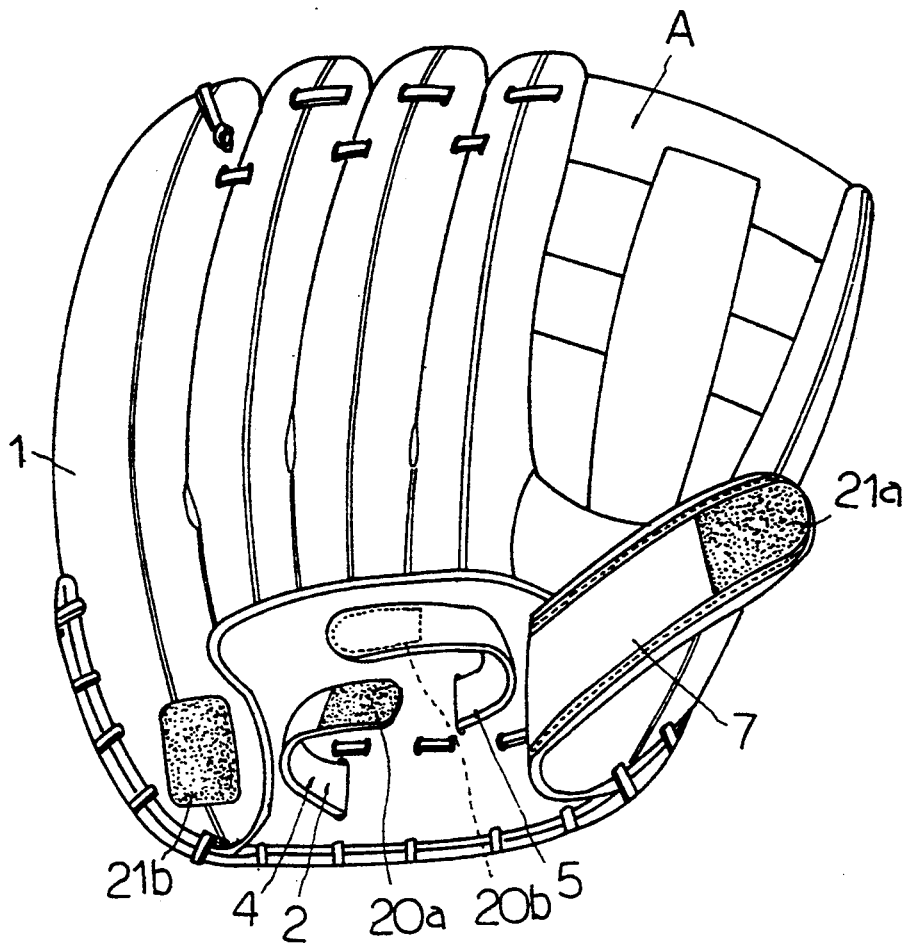
FIG. 12 is a perspective view showing a state in which the belt portion of the baseball glove of the fourth embodiment is opened.

According to the baseball glove A of the fourth embodiment, furthermore, the hand 3 is inserted into the glove body 1 in position between the belt member 4 and the belt member 5, as shown in FIG. 12, and is then wrapped by the belt members 4 and 5. After this, the belt members 4 and 5 are fastened at their inner face fasteners 20*a* and 20*b*, and the belt portion 7 of the glove body 1 can then be so fastened by the outer face fasteners 21*a* and 21*b* as to wrap the palm of the hand.

Thus, according to the baseball glove A of the first embodiment of the present invention, as shown in FIG. 1, the belt member 5 is inserted into the ring member 9 of the stopper 10 of the fixing means 2 and is folded back and pulled while being retained by the retainer 8 so that the inserted hand 3 is gripped sideways by the belt members 4 and 5 and by the back of the belt portion 7 and the surface of the lining 6 of the glove body 1. As a result, the baseball glove A raises no obstruction to the play and allows the hand 3 to be freely bent while giving an excellent fitness for the player to play accurately. Moreover, the baseball glove A is not pushed to come out even if it is involved in a close play.

Moreover, the belt members 4 and 5 of the fixing means 2 are positioned at the two sides of the hand 3, so that the inserted hand 3 is gripped sideways by the belt members 4 and 5 and by the back of the belt portion and the surface of the lining 6 of the glove body 1. As a result, the hand 3 is wholly gripped in good balance without any offset merely by fastening the belt member 5 so that the baseball glove A can be handled with ease and felt lighter than the real weight.

Especially, in case the fixing means 2 of the second to fifth embodiments are used, the hand is gripped at two portions by the belt members 4 and the belt members 5 so that the gripping effect can be enhanced. Especially according to the fixing means 2 of the fifth embodiment, the fitness with the glove body 1 can be improved by positioning the thumb in the insert hole 11*a* of the connector 11.

According to the baseball glove A of the second embodiment, furthermore, the hand 3 is gripped in the glove body 1 by the fixing means 2 as in the baseball glove A of the first embodiment. After this, the wrist is further gripped firmly by the wrap portion 14*a* of the auxiliary belt member 14 of the auxiliary fixing means 13. As a result, the fitness is enhanced by the auxiliary fixing means 13 so that the baseball glove A becomes more reluctant to come out.

According to the baseball glove A of the fourth embodiment, furthermore, the belt member 4 and the belt member 5 of the fixing means 2 can be easily fastened and removed by the inner face fasteners 20*a* and 20*b*, as shown in FIG. 12, and the belt portion 7 of the glove body 1 can also be easily fastened and removed by the outer face fasteners 21*a* and 21*b*.

With the constructions thus far described, the present invention has the following effects.

According to the baseball catching tool of claim 1, the hand is gripped in the tool by inserting it into the tool and by fastening the belt members of the fixing means. As a result, the baseball tool raises no obstruction to the play and allows the hand to be freely bent while giving an excellent fitness for the player to play accurately. Moreover, the baseball tool is not pushed to come out even if it is involved in a close play.

According to the baseball catching tool of claim 2, the inserted hand is gripped sideways by the belt members and by the back of the belt portion and the surface of the lining of the tool body. As a result, the hand is wholly gripped in good balance without any offset merely by fastening the belt member so that the baseball tool can be handled with ease and felt lighter than the real weight.

According to the baseball catching tool of claim 3, the belt members are fastened while positioning the thumb in the bifurcated roots of one of the belt members, so that the gripped hand can be completely prevented from moving out of position.

What is claimed is:

1. A catching tool, comprising:

a glove body;

said glove body having a front side and a rear side, and having an opening for inserting one's hand into a chamber between said front side and said rear side, and having a portion for receiving one's thumb and a portion for receiving one's fingers;

a first belt portion extending from one of said front and rear sides into said chamber;

a second belt portion extending from said one of said front and rear sides into said chamber;

a fixing device for fixing said first and second belt portions together;

said second belt portion being at a first location within said glove a sufficient distance from said opening and at a location proximate to said thumb portion such that a portion of said second belt portion extends upwardly in-between one's thumb and forefinger;

said first belt portion being at a second location within said glove a sufficient distance from said opening and at a location at a side of one's hand opposite to said thumb portion such that a portion of said first belt portion extends upwardly proximate said side of one's hand opposite to said thumb portion;

whereby when said fixing device fixes said first and second belt portions together, said first and second belt portions effect a holding force around the palm of one's hand.

2. A catching tool according to claim 1, wherein:

said first belt portion extends through a first opening in the other of said front and rear sides, and said second belt portion extends through a second opening in said other of said front and rear sides, and said other of said front and rear sides includes a belt portion which extends between portions of said first and second belt portions and one's inserted hand, and said fixing device is located on an outside surface of said belt portion at an opposite from one's inserted hand.

3. A catching tool according to claim 1, wherein each of said first and second belt portions have roots which are bifurcated a sufficient amount and at a position to enable one to position the thumb of the hand in the bifurcated root of said second belt portion and to enable said first belt portion to straddle the side of the hand opposite to said thumb portion.

4. A catching tool according to claim 2, wherein each of said first and second belt portions have roots which are bifurcated a sufficient amount and at a position to enable one to position the thumb of the hand in the bifurcated root of said second belt portion and to enable said first belt portion to straddle the side of the hand opposite to said thumb portion.

5. A catching tool according to claim 1, wherein each of said first and second belt portions includes two generally parallel belt portions, each of said two generally parallel belt portions being spaced a sufficient amount and at a position to enable one to position the thumb of the hand in between each of said generally parallel belt portions of said second belt portion and to enable said generally parallel belt portions of said first belt portion to straddle the side of the hand opposite to said thumb portion.

6. A catching tool according to claim 1, wherein said second belt portion has a wide base portion and includes a through hole therethrough which is a sufficient size and at a position to enable one to position the thumb of the hand therethrough.

7. A method of gripping a catching tool to one's hand, comprising the steps of:

(a) providing a catching tool, comprising:

a glove body;

said glove body having a front side and a rear side, and having an opening for inserting one's hand into a chamber between said front side and said rear side, and having a portion for receiving one's thumb and a portion for receiving one's fingers;

a first belt portion extending from one of said front and rear sides into said chamber;

a second belt portion extending from said one of said front and rear sides into said chamber;

a fixing device for fixing said first and second belt portions together;

said second belt portion being at a first location within said glove a sufficient distance from said opening and at a location proximate to said thumb portion such that a portion of said second belt portion extends upwardly in-between one's thumb and forefinger;

said first belt portion being at a second location within said glove a sufficient distance from said opening and at a location at a side of one's hand opposite to said thumb portion such that a portion of said first belt portion extends upwardly proximate said side of one's hand opposite to said thumb portion;

whereby when said fixing device fixes said first and second belt portions together, said first and second belt portions effect a holding force around the palm of one's hand;

(b) placing one's hand into said catching tool with said portion of said second belt portion extending upwardly in-between one's thumb and forefinger, and with said first belt portion being at said side of one's hand opposite to said thumb portion such that a portion of said first belt portion extends upwardly proximate said side of one's hand opposite to said thumb portion; and (c) gripping said catching tool to one's hand by operating said fixing device.

* * * * *